US006053432A

United States Patent [19]

Stevens

[11] Patent Number: 6,053,432

[45] Date of Patent: Apr. 25, 2000

[54] FUEL INJECTOR

[75] Inventor: John William Stevens, Gillingham, United Kingdom

[73] Assignee: Lucas Industries, PLC, London, United Kingdom

[21] Appl. No.: 09/368,447

[22] Filed: Aug. 4, 1999

[30] Foreign Application Priority Data

Sep. 11, 1998 [GB] United Kingdom ..... 9819746

[51] Int. Cl.[7] ..... F02M 61/00

[52] U.S. Cl. ..... 239/533.2; 239/533.3; 239/533.11; 239/583; 239/584

[58] Field of Search ..... 239/533.2, 533.3, 239/533.11, 583, 584, 397.5, 533.4, 533.5, 533.6, 533.8, 533.9, 533.12, 533.14

[56] References Cited

U.S. PATENT DOCUMENTS 3,323,726 6/1967 Heintz ..... 239/533.1
3,669,361 6/1972 Guèrt ..... 239/533.2 X
4,813,600 3/1989 Shultz et al. ..... 239/533.3 X
5,738,283 4/1998 Potz et al. ..... 239/533.3

*Primary Examiner*—Andres Kashnikow
*Assistant Examiner*—Robin O. Evans
*Attorney, Agent, or Firm*—Wells, St. John, Roberts, Gregory & Matkins, P.S.

[57] ABSTRACT

A fuel injector comprising a nozzle body, a bore provided in the nozzle body within which a valve needle is slidable, the valve needle and the bore being shaped to include a guide region where the valve needle and the bore are of substantially identical diameter, the engagement between the valve needle and the bore in the guide region serving to guide the valve needle for sliding movement within the bore, wherein the fuel injector includes a collar extending around part of the nozzle body, the collar engaging the nozzle body to restrict dilation of the bore in at least part of the guide region.

8 Claims, 1 Drawing Sheet

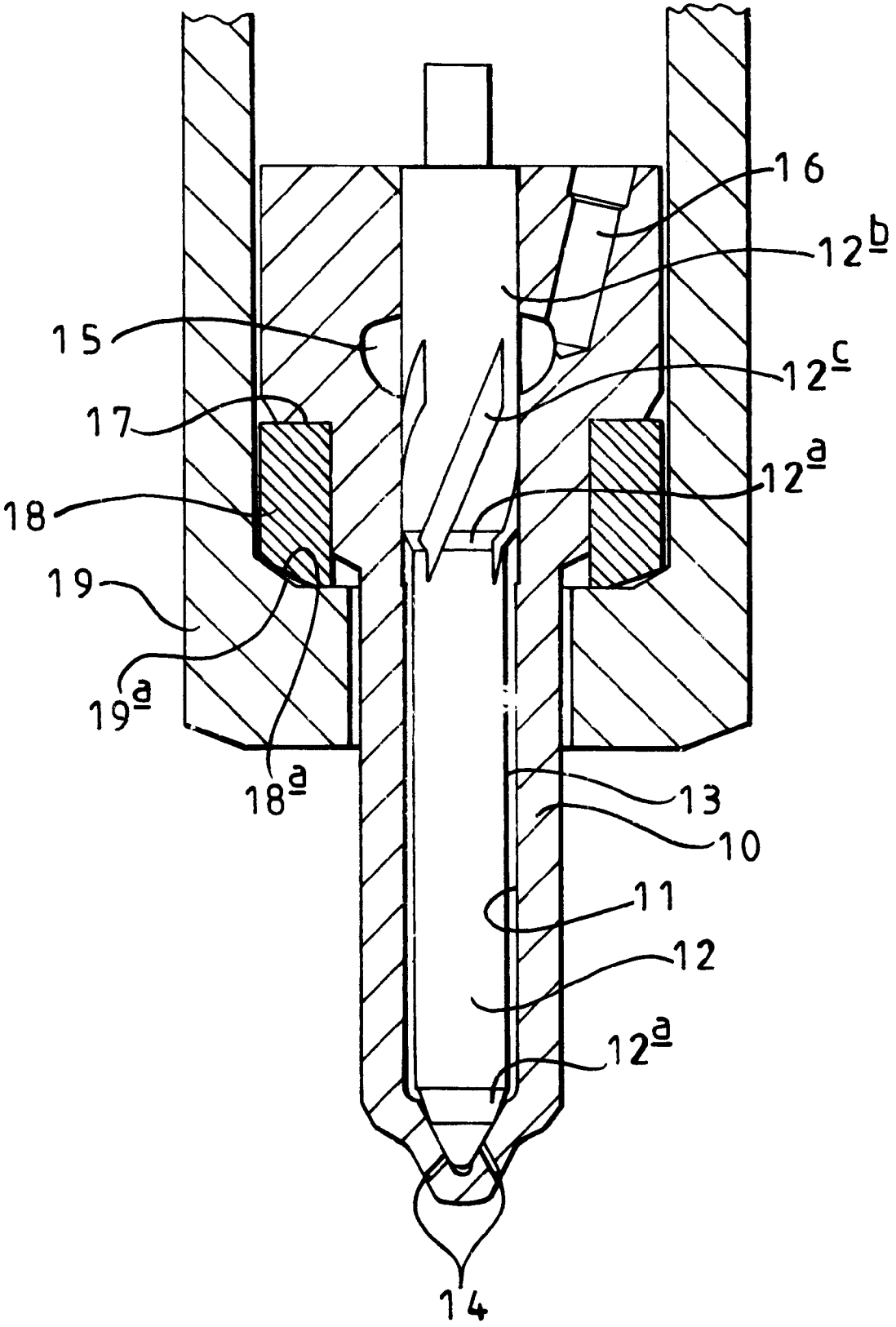
16
12b
15
12c
17
12a
18
19
19a
18a
13
10
11
12
12a
14

FUEL INJECTOR

This invention relates to a fuel injector for use in delivering fuel at high pressure to a cylinder or combustion space of an associated internal combustion engine.

During fuel injection it is common for the valve needle of a fuel injector to be held in a position spaced by a small distance from a seating, and when the needle is lifted by such a small distance it is desirable to ensure that the needle and seating remain concentric throughout the period during which the needle is lifted, particularly where the lift of the needle is used to control the injection rate, as otherwise the quality of the injection spray formation can be impaired. In order to assist in ensuring that the needle remains concentric with the seating, it is known to increase the length of the part of the needle which contacts the surface of the bore within which the needle is slidable to improve guidance of the needle.

The fuel pressures at which such injectors operate are such that the fuel pressure within the bore of the injector dilates the bore, such dilation permitting lateral movement of the needle to occur. Clearly, such movement results in the needle no longer remaining concentric with the seating, and is undesirable.

It is an object of the invention to provide a fuel injector in which this disadvantage is of reduced effect.

According to the present invention there is provided a fuel injector comprising a nozzle body, a bore provided in the nozzle body within which a valve needle is slidable, the valve needle and the bore being shaped to include a guide region where the valve needle and the bore are of substantially identical diameter, the engagement between the valve needle and the bore in the guide region serving to guide the valve needle for sliding movement within the bore, and a collar extending around part of the nozzle body, the collar engaging the nozzle body to restrict dilation of the bore in at least part of the guide region.

The collar is conveniently an interference fit on the nozzle body.

The provision of the collar acts, in effect, to increase the wall thickness of the nozzle body and also applies a compressive load to the nozzle body, these effects acting to improve the ability of the nozzle body to withstand the application of fuel under high pressure to the bore thereof without dilation of the bore occurring to an unacceptably large extent.

The invention will further be described, by way of example, with reference to the accompanying drawing which is a sectional view illustrating part of a fuel injector in accordance with an embodiment of the invention.

The accompanying drawing illustrates part of a fuel injector, the drawing illustrating a nozzle body 10 within which a blind bore 11 of stepped form is provided, a valve needle 12 being reciprocable within the bore 11. The needle 12 and bore 11 together define a delivery chamber 13, the needle 12 including thrust surfaces 12*a* exposed to the fuel pressure within the delivery chamber 13 such that the application of fuel under high pressure to the delivery chamber 13 applies a force to the needle 12 urging the needle 12 in a direction away from a seating formed adjacent the blind end of the bore to permit fuel to flow past the seating to one or more outlet openings 14 located downstream of the seating.

The needle 12 includes a guide region 12*b* of diameter substantially equal to the diameter of the adjacent part of the bore 11, the guide region 12*b* of the needle 12 engaging the surface defining the bore 11 and serving to guide the needle 12 for sliding movement within the bore 11 whilst maintaining the needle 12 concentric relative to the seating.

A part of the bore 11 adjacent the guide region 12*b* of the needle 12 is shaped to define an annular gallery 15 which communicates with a drilling 16 forming part of a supply passage. The part of the needle 12 between the annular gallery 15 and the delivery chamber 13 is shaped to define flutes 12*c* whereby fuel is able to flow from the annular gallery 15 to the delivery chamber 13, in use.

The nozzle body 10 is shaped to define a region of relatively large diameter and a region of smaller diameter, these regions being interconnected at a shoulder 17 which is located at a level substantially adjacent the annular gallery 15. It will be appreciated that the relatively large diameter part of the nozzle body 10 is able to withstand the application of fuel under relatively high pressure to the bore 11, but the smaller diameter part of the nozzle body 10 is less able to withstand the application of fuel under high pressure to the bore 11 without unacceptably high levels of dilation occurring, in use. Although dilation of the bore 11 in the region of the delivery chamber 13 is of relatively little concern, dilation of the parts of the bore 11 forming the guide region is undesirable as such dilation may result in accurate guiding of the needle 12 being impaired, and hence in the needle 12 no longer remaining concentric with the seating. In order to restrict or avoid such dilation of the part of the bore 11 forming the guide region with which the guide region 12*b* of the needle engages, a collar 18 is located around the nozzle body 10, the collar 18 being an interference fit with the adjacent part of the nozzle body 10 and applying a compressive force thereto, the collar 18 being located and secured in position conveniently using a thermal expansion technique. As the relatively large diameter part of the nozzle body 10 is able to withstand dilation to a greater extent than the smaller diameter part of the nozzle body 10, the collar 18 is only located around the smaller diameter part of the nozzle body 10 adjacent the guide region. It will be appreciated however, that if desired, the collar 18 could be located around a greater part of the nozzle body.

In order to permit the nozzle body 10 and collar 18 to be secured to the remainder of a fuel injector of any suitable type, a cap nut 19 is provided, the cap nut 19 engaging the collar 18 to clamp the collar 18 and the nozzle body 10 to the remainder of the fuel injector.

The injector may, for example, take the form of a fluid pressure actuated injector, fuel being supplied to the supply passage of the injector by an appropriate fuel pump. Alternatively, the injector may comprise, for example, a common rail injector or a unit pump injector.

As illustrated in the accompanying drawing, the collar 18 is provided with an angled, frusto-conical surface 18*a* which is engaged, in use, by a frusto-conical surface 19*a* forming part of the cap nut 19 to apply the necessary clamping force, in use. The use of such angled surfaces in applying the clamping force to the injector results in the clamping force having a radial component which assists in reducing dilation of the bore 11, in use.

The provision of a collar 18 is further advantageous in that it permits a standard nozzle body 11 and needle 12 to be adapted for use in a relatively wide variety of applications, effectively by adjusting the axial length of the relatively large diameter part of the nozzle body 10.

I claim:

1. A fuel injector comprising a nozzle body, a bore provided in said nozzle body within which a valve needle is slidable, said valve needle and said bore being shaped to include a guide region where said valve needle and said bore are of substantially identical diameter, engagement between said valve needle and said bore in said guide region serving to guide said valve needle for sliding movement within said bore, the fuel injector further comprising a collar extending around part of said nozzle body, said collar engaging said nozzle body to restrict dilation of said bore in at least part of said guide region.

2. The fuel injector as claimed in claim 1, wherein said collar is an interference fit on said nozzle body.

3. The fuel injector as claimed in claim 1, wherein said nozzle body has parts of relatively smaller and relatively larger diameter adjacent said guide region.

4. The fuel injector as claimed in claim 3, wherein said collar is located only around said relatively smaller diameter part of said nozzle body.

5. The fuel injector as claimed in claim 3, wherein said collar is located around said relatively smaller diameter part of said nozzle body and at least part of said relatively larger diameter part of said nozzle body.

6. The fuel injector as claimed in claim 1, further comprising clamping means for applying a clamping force to said fuel injector to clamp said collar and said nozzle body in place.

7. The fuel injector as claimed in claim 6, wherein said clamping means are a cap nut.

8. The fuel injector as claimed in claim 6, wherein said collar has a surface of substantially frusto-conical form which engages a surface of said clamping means, wherein said surface of said clamping means is also of substantially conical form.

* * * * *